US005584380A

United States Patent [19]

Naitou

[11] Patent Number: 5,584,380

[45] Date of Patent: Dec. 17, 1996

[54] SEESAW SWITCH

[75] Inventor: Kiyotaka Naitou, Yokkaichi, Japan

[73] Assignee: Sumitomo Wiring Systems, Ltd., Japan

[21] Appl. No.: 282,050

[22] Filed: Jul. 28, 1994

[30] Foreign Application Priority Data

Sep. 2, 1993 [JP] Japan ..... 5-052993

[51] Int. Cl.[6] ..... H01H 9/00

[52] U.S. Cl. ..... 200/315; 200/339; 200/553

[58] Field of Search ..... 200/553, 557, 200/561, 339, 520, 5 R, 517, 341, 315

[56] References Cited

U.S. PATENT DOCUMENTS 4,401,864 8/1983 Ichikawa ..... 200/339

5,115,108 5/1992 Ogawa et al. ..... 200/512

5,396,030 3/1995 Matsumiya et al. ..... 200/339

*Primary Examiner*—David J. Walczak

*Attorney, Agent, or Firm*—Jordan B. Bierman; Bierman and Muserlian

[57] ABSTRACT

There is disclosed a seesaw switch which includes two rubber contacts (4*a*, 4*b*) juxtaposed on a printed board (2) within a case (1) defining a through hole (6) above the rubber contacts (4*a*, 4*b*), a key button (12) inserted in the through hole (6) from inside the case (1) and placed on pushing elements (5*a*, 5*b*) formed on the rubber contacts (4*a*, 4*b*), and a collar portion (22) formed at lower end of the key button (12) and abutting against an inner surface of the case (1) on the periphery of the through hole (6).

7 Claims, 3 Drawing Sheets

SEESAW SWITCH

BACKGROUND OF THE INVENTION

1. Field of the Invention

The present invention relates to a seesaw switch for switching on and off in seesaw fashion by a push of a key button at either end thereof.

2. Description of the Prior Art

Conventionally, a seesaw switch used for an automotive power window switch is constructed, for example, as shown in FIGS. 4 and 5.

Referring to FIGS. 4 and 5, a printed board 2 on which various electronic components are mounted is provided in a case 1, and left-hand and right-hand fixed contacts 3*a* and 3*b* are formed by a copper pattern as a conductive portion on an upper surface of the printed board 2. Left-hand and right-hand rubber contacts 4*a*, 4*b* made of silicone rubber are placed above the fixed contacts 3*a*, 3*b* formed on the printed board 2, and left-hand and right-hand pushing elements 5*a*, 5*b*, of a T-shaped cross-sectional configuration are placed on the rubber contacts 4*a*, 4*b*, respectively.

A rectangular through hole 6 is formed in the case 1 above the rubber contacts 4*a*, 4*b*, and support shafts 7 are mounted on front and rear peripheral side surfaces of the through hole 6.

In the case 1 is provided a base 9 having a lower surface defining recesses 10*a*, 10*b* receiving upper portions of the rubber contacts 4*a*, 4*b* and lower portions of the pushing elements 5*a*, 5*b*. The recesses 10*a*, 10*b* of the base 9 have through holes formed respectively centrally thereof and receiving shaft portions of the pushing elements 5*a*, 5*b*, and upper portions of the shaft portions of the pushing elements 5*a*, 5*b*, are directed upwardly of the base 9.

A key button 12 having an exterior dimension slightly smaller than the interior dimension of the through hole 6 is inserted in the through hole 6 from below the case 1, with play held between the key button 12 and the through hole 6. Left-hand and right-hand ends of the key button 12 are placed on the pushing elements 5*a*, 5*b*, formed on the rubber contacts 4*a*, 4*b*, respectively. The key button 12 has front and rear peripheral surfaces defining apertures 13 receiving the support shafts 7 so that the key button 12 is supported for seesaw operation.

A light emitting device 14 is provided between the fixed contacts 3*a* and 3*b*on the printed board 2 and housed in a receiving recess formed in the base 9. The light emitting device 14 illuminates a light-pervious window portion of a character-shaped configuration formed on an upper surface of the key button 12.

In such an arrangement, pushing the key button 12 at its left-hand end against the elasticity of the rubber contact 4*a* permits the key button 12 to pivot on the support shafts 7 in the pushing direction, and the key button 12 presses and deforms the rubber contact 4*a* through the pushing element 5*a*. Then a conductor 16*a* bonded on the rubber contact 4*a* comes into contact with the fixed contact 3*a*, and electrical connection is made between the conductor 16*a* and the fixed contact 3*a*. Pushing the key button 12 at its right-hand end provides similar operation wherein a conductor 16*b* comes into contact with the fixed contact 3*b* and electrical connection is made between the conductor 16*b* and the fixed contact 3*b*.

The interior dimension of the through hole 6 is slightly greater than the exterior dimension of the key button 12 so that the left-hand and right-hand ends of the key button 12 when pivoted do not contact the peripheral surfaces of the through hole 6, and the key button 12 is inserted in the through hole 6, with play held therebetween.

Another conventional seesaw switch is shown in FIGS. 6 and 7. The differences from the construction of FIGS. 4 and 5 are described below. A guide wall 18 extending downwardly is formed integrally with the case 1 on the periphery of the through hole 6. The guide wall 18 includes a partition board 19 for closing the lower opening of the guide wall 18, and a rectangular through hole 20 for housing the light emitting device 14 is formed centrally of the partition board 19. Through holes 21*a*, 21*b* for the shaft portions of the pushing elements 5*a*, 5*b*, are formed on the left and right of the through hole 20 of the partition board 19, and the upper portions of the shaft portions of the pushing elements 5*a*, 5*b*, are directed through the through holes 21*a*, 21*b* upwardly of the partition board 19 for abutment against the left-hand and right-hand ends of the key button 12, respectively.

However, the foregoing arrangements necessitate the provision of the shafts 7 on the front and rear peripheral side surfaces of the through hole 6. The techniques of providing the shafts 7 include forming the shafts 7 from separate members and forming the shafts 7 by using a sliding die for forming the through holes 13 of the key button 12. On the other hand, a sliding die for forming the shaft holes in the case 1 is used to provide the shafts 7 on the key button 12. Forming the shafts 7 from the separate members results in an increased number of components, and forming the shafts 7 by using the sliding die results in increased costs of the die.

Another drawback is that the provision of the light emitting device 14 for character illumination causes the through hole 6 to have the interior dimension greater than the exterior dimension of the key button 12, resulting in light coming outwardly through the gap-between the case 1 and the key button 12 when the switching operation is not being performed.

SUMMARY OF THE INVENTION

The present invention is intended for a seesaw switch for switching on and off an electric circuit by pivotal movement of a key button pushed selectively at either end. According to the present invention, the seesaw switch comprises: a case having a through hole, the key button being inserted into the through hole from inside, with play held between the through hole and the key button; a printed board within the case; two elastic elements below the through hole and placed on the printed board; two conductors mounted respectively to the elastic elements for contacting conductive portions formed on the printed board when the elastic elements are deformed; a collar portion formed integrally with the key button at its lower end and abutting against an inner surface of the case on the periphery of the through hole; and two pushing elements placed respectively on the elastic elements and abutting at their upper ends against opposite lower ends of the key button to transmit an upward urging force of the elastic elements to opposite ends of the key button.

When the key button is not pushed, the collar portion of the key button urged upwardly by the elastic element through the pushing element abuts against the inner surface of the case on the periphery of the through hole. In this state, when the key button is pushed at its left-hand or right-hand end, the opposite end of the collar portion from the pushed end remains abutting against the inner surface of the case on the periphery of the through hole, and the key button is pivoted about the opposite end of the collar portion. Then the key button presses and deforms the elastic element through the pushing element at the pushed end. The prior art shafts about which the key button is pivoted need not be separately provided.

As above described, according to the present invention, the key button is disposed for seesaw operation only by placing the key button on the pushing elements formed on the elastic elements. The seesaw switch of the present invention is not required to provide the prior art shafts, and adds to neither the number of components nor die costs, providing a good assembling efficiency. Further, the abutment of the collar portion against the inner surface of the case allows the gap to be closed between the key button and the case during no switching operation, to securely prevent light from the light emitting device for character illumination, if provided, from coming outwardly.

Preferably, the seesaw switch further comprises: a restrictive element fixed adjacent the elastic elements in the case so as to prevent both of the conductors from simultaneously contacting the conductive portions of the printed board, the restrictive element restricting a further push of the key button having a lower middle portion abutting thereagainst when a substantially middle portion of the key button is pushed.

Preferably, the seesaw switch further comprises: a raised portion raised downwardly from a substantially middle lower portion of the key button so as to prevent both of the conductors from simultaneously contacting the conductive portions of the printed board, the raised portion abutting against the restrictive element to prevent the push of the key button when the substantially middle portion of the key button is pushed.

The further provision of the restrictive element and the raised portion permits restriction of the push of the key button having the raised portion abutting against the restrictive element when the middle portion of the key button is pushed, thereby avoiding the simultaneous push.

An object of the present invention is to provide a seesaw switch which has a good assembling efficiency without increasing in the number of components and in die cost and which prevents light from a light emitting device for character illumination, if provided, from coming outwardly.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
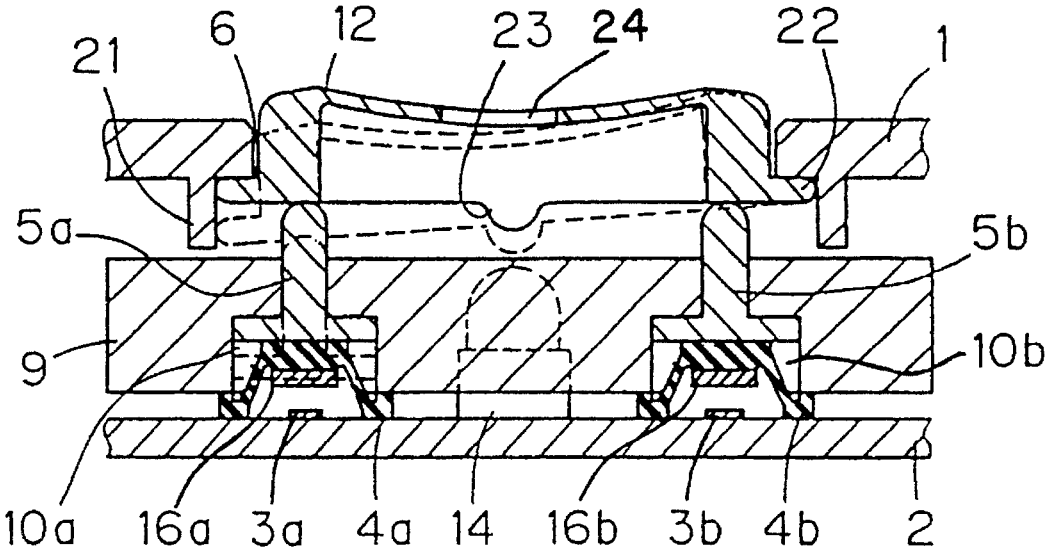
FIG. 1 is a front view in cross section of a preferred embodiment according to the present invention.
Figure 2:
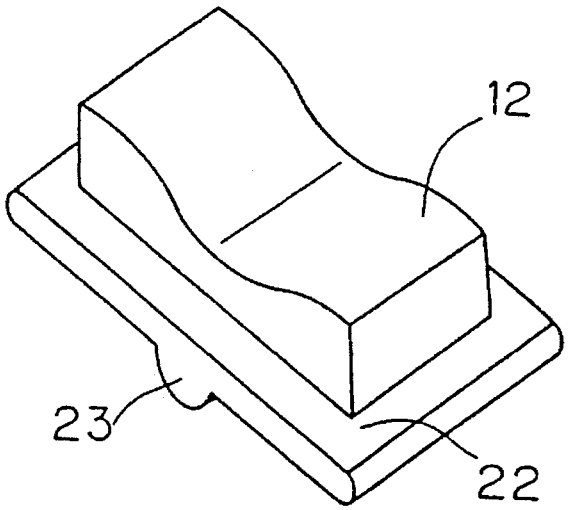
FIG. 2 is a perspective view of some portions of FIG. 1 as viewed from above.
Figure 3:
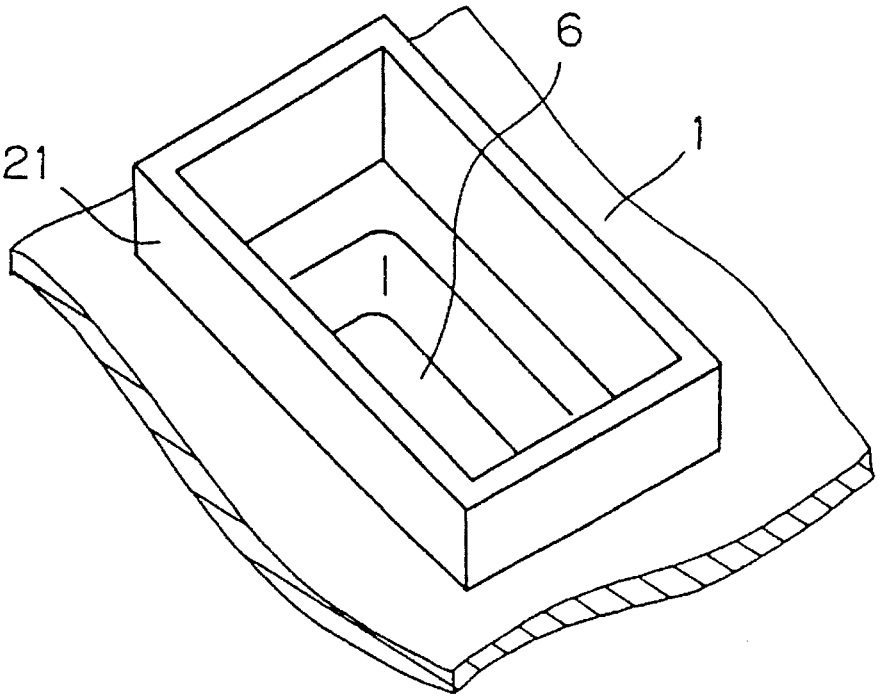
FIG. 3 is a perspective view of other portions of FIG. 1 as viewed from below.

FIG. 1 is a front view in cross section of a preferred embodiment according to the present invention. FIG. 2 is a perspective view of some portions of FIG. 1 as viewed from above. FIG. 3 is a perspective view of other portions of FIG. 1 as viewed from below.

Figure 4:
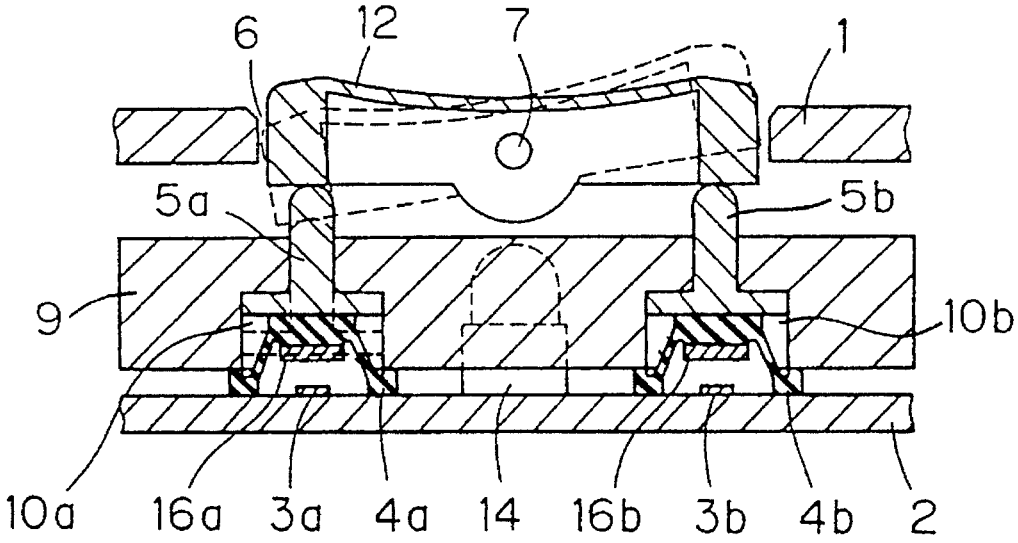
FIG. 4 PRIOR ART
FIG. 4 is a front view in cross section of a conventional seesaw switch.
Figure 5:
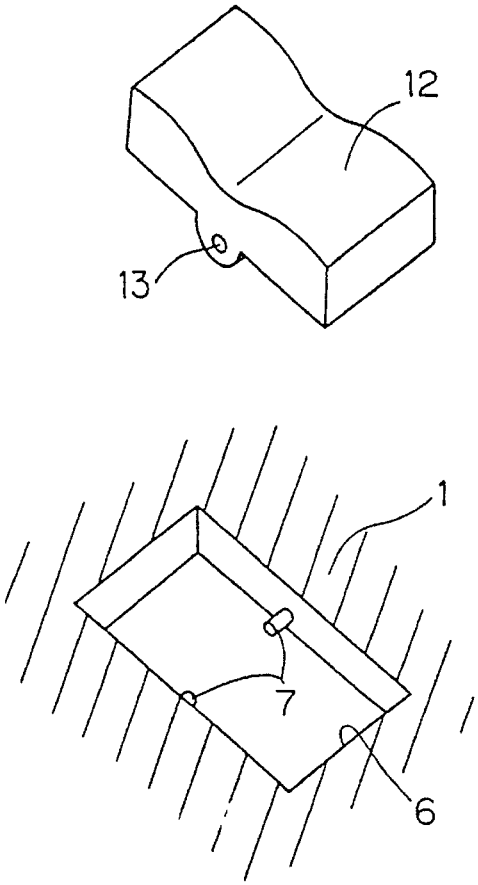
FIG. 5 PRIOR ART
FIG. 5 is an exploded perspective view of FIG. 4.
Figure 7:
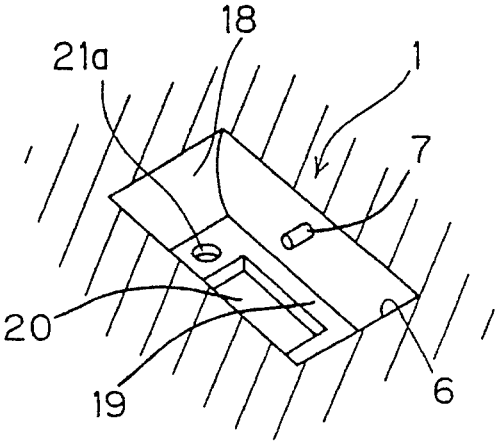
FIG. 7 PRIOR ART
FIG. 7 is a perspective view of some portions of FIG. 6.
Figure 6:
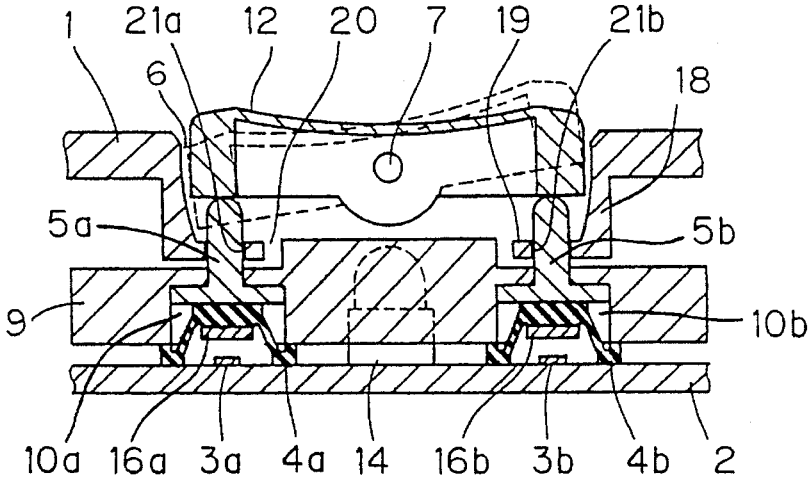
FIG. 6 PRIOR ART
FIG. 6 is a front view in cross section of another conventional seesaw switch.

In FIGS. 1 to 3, like reference numerals and characters are used to designate parts identical with or corresponding to those of FIGS. 4 and 5. The differences from the construction of FIGS. 4 and 5 are described below.

A short, rectangularly tubular guide portion 21 is formed integrally with the periphery of the through hole 6 on a lower surface of the case 1 (FIGS. 1 and 3). A collar portion 22 having an exterior dimension slightly smaller than the interior dimension of the guide portion 21 is formed integrally with the key button 12 at its lower end (FIGS. 1 and 2). The key button 12, having light pervious window portion 24 and including the collar portion 22, is housed within the guide portion 21. A raised portion 23 of a semicircular cross-sectional configuration is formed integrally with the key button 12 and raised downwardly from a lower middle portion of the key button 12.

The left-hand and right-hand end surfaces of the collar portion 22 are worked into a curved surface.

The base 9 functions as a restrictive element for restricting a further push of the key button 12 having the raised portion 23 abutting against the base 9 when a middle portion of the key button 12 is pushed. This prevents such a simultaneous push that the whole key button 12 being pushed moves downwardly to deform both of the rubber contacts **4*a*, 4*b* to make electrical connection between the contact 3*a* and the conductor 16*a* and between the contact 3*b* and the conductor 16*b*** simultaneously.

When the key button 12 is not pushed, the elasticity of the rubber contacts **4*a*, 4*b* urges the key button 12 upwardly through the pushing elements 5*a*, 5*b*, thereby to cause the collar portion 22 to abut against an inner surface of the case 1 on the periphery of the through hole 6. In this state, when the key button 12 is pushed, for example, at its left-hand end, the key button 12 is pivoted about a right-hand portion of the collar portion 22 abutting against the inner surface of the case 1 on the periphery of the through hole 6, and the left-hand end of the key button 12 moves downwardly against the elasticity of the rubber contact 4*a*. Then the key button 12 presses and deforms the rubber contact 4*a* through the pushing element 5*a* to bring the conductor 16*a* into contact with the contact 3*a*. Electrical connection is made between the contact 3*a* and the conductor 16*a***.

Pushing the key button 12 at its right-hand end provides similar operation wherein the rubber contact **4*b* is deformed to bring the conductor 16*b* into contact with the contact 3*b* and electrical connection is made between the conductor 16*b* and the contact 3*b***.

Accordingly, there is no need to provide a shaft about which the key button 12 is pivoted, thereby adding to neither the number of components nor die costs of the prior art. The key button 12 is required only to be disposed on the pushing elements **5*a*, 5*b***, thereby being adapted for seesaw operation. This enhances an assembling efficiency.

The provision of the collar portion 22 in the key button 12 eliminates the gap between the key button 12 and the case 1 and securely prevents light from the light emitting device 14 from coming outwardly.

The provision of the raised portion 23 abutting against the base 9 serving as the restrictive element securely prevents the simultaneous push of the seesaw switch.

The raised portion 23 of the key button 12 need not particularly be provided. When the raised portion 23 is not provided, selection is enabled among three states including the simultaneous push state.

The elastic element is not limited to the rubber contacts 4*a*, 4*b*, and the restrictive element is not limited to the base 9.

While the invention has been shown and described in detail, the foregoing description is in all aspects illustrative and not restrictive. It is therefore understood that numerous modifications and variations can be devised without departing from the scope of the invention.

What is claimed is:

1. A seesaw switch for switching an electric circuit on and off comprising a key button adapted to be pushed toward, and biased away from, said electric circuit, a case having a through hole, defined by a periphery, said key button being inserted into said through hole, with a space between said periphery and said key button;

a printed board within said case and adapted to carry said electric circuit, two elastic elements below said through hole and placed on said printed board;

a conductor connected to each of said elastic elements for contacting conductive portions formed on said printed board when said elastic elements are deformed;

a collar portion integral with said key button at a lower end thereof and abutting against an inner surface of said case on said periphery of said through hole;

a light emitter between said key button and said printed board, said collar portion preventing escape of light from said emitter through said space; and a pushing element formed separately from said elastic elements and said key button and placed on each of said elastic elements, each pushing element abutting at an upper end thereof against an opposite lower end of said key button to transmit an upward urging force of said elastic elements to each said opposite end of said key button.

2. The seesaw switch of claim 1 further comprising a restrictive element fixed adjacent said elastic elements in said case so as to prevent both of said conductors from simultaneously contacting said conductive portions of said printed board, said restrictive element restricting a push of said key button, said key button having a lower middle portion abutting against said restrictive element when a substantially middle portion of said key button is pushed.

3. The seesaw switch of claim 2, further comprising:

a raised portion raised downwardly from a substantially middle lower portion of said key button, said raised portion abutting against said restrictive element to prevent movement of said key button toward said printed board when the substantially middle portion of said key button is pushed.

4. The seesaw switch of claim 1, wherein said key button has an upper surface defining a light-pervious window portion, said seasaw switch further comprising:

said light emitter mounted on said printed board for illuminating said window portion from inside.

5. The seesaw switch of claim 4 further comprising:

a restrictive element fixed adjacent said elastic elements in said case so as to prevent both of said conductors from simultaneously contacting said conductive portions of said printed board, said restrictive element restricting a push of said key button, said key button having a lower middle portion abutting against said restrictive element when a substantially middle portion of said key button is pushed.

6. The seesaw switch of claim 5, further comprising:

a raised portion raised downwardly from a substantially middle lower portion of said key button, said raised portion abutting against said restrictive element to prevent movement of said key button toward said printed board when the substantially middle portion of said key button is pushed.

7. The seesaw switch of claim 1 wherein said key button is adapted for pivotal movement about alternate fulcrums, one of said fulcrums being on said collar portion at a first point remote from a first of said elastic elements, another of said fulcrums being on said collar at a second point remote from a second of said elastic elements, said second point being circumferentially spaced apart from said first point.

* * * * *